United States Patent [19]

Stevenson

[11] Patent Number: 4,815,484

[45] Date of Patent: Mar. 28, 1989

[54] STYLING COMB FOR USE IN HAIR TREATMENTS

[76] Inventor: James A. Stevenson, 3208 Cole Ave., 190 2105, Dallas, Tex. 75204

[21] Appl. No.: 175,848

[22] Filed: Mar. 31, 1988

[51] Int. Cl.[4] ..... A45D 24/02

[52] U.S. Cl. ..... 132/161; 132/137

[58] Field of Search ..... 132/161, 137, 138, 11 R

[56] References Cited

U.S. PATENT DOCUMENTS

| | | | |
|---|---|---|---|
| 952,491 | 3/1910 | Youngs | 132/161 |
| 973,361 | 10/1910 | Lynch | 132/161 |
| 1,281,227 | 10/1918 | Sumitani | 132/137 |
| 2,139,709 | 12/1938 | Yaw | 132/161 |
| 2,246,746 | 6/1941 | McCoy | 132/161 |
| 2,275,077 | 3/1942 | Higgins | 132/161 |
| 2,380,730 | 7/1945 | Demyanovich | 132/161 |
| 2,384,152 | 9/1945 | Black | 132/161 |
| 2,505,005 | 4/1948 | Reiter | 132/162 |
| 3,180,342 | 1/1963 | Dietsche | 132/160 |
| 3,181,540 | 3/1963 | Abraham | 132/161 |
| 3,382,877 | 5/1968 | Cercone | 132/137 |
| 3,952,755 | 4/1976 | Fisher | 132/161 |
| 4,566,472 | 1/1986 | Mueller | 132/161 |

FOREIGN PATENT DOCUMENTS

| | | | |
|---|---|---|---|
| 133674 | 1/1933 | Austria | 132/161 |
| 162420 | 5/1904 | Fed. Rep. of Germany | 132/161 |
| 767780 | 7/1934 | France | 132/161 |
| 1253367 | 1/1961 | France | 132/161 |

*Primary Examiner*—Paul J. Hirsch

*Attorney, Agent, or Firm*—David H. Judson

[57] ABSTRACT

A styling comb for use in hair treatments advantageously provides a variety of divisions for hair sections to enable careful and accurate treatment of hair. The styling comb includes a back portion, a handle portion connected to the back portion, and first and second sets of teeth arranged in an outwardly projecting manner from the back portion. The first set of teeth is separated into two interleaved levels, while the second set of teeth is arranged in three interleaved levels.

6 Claims, 1 Drawing Sheet

STYLING COMB FOR USE IN HAIR TREATMENTS

TECHNICAL FIELD

The present invention relates generally to styling combs and more particularly to a multi-sided comb for subdividing a section of hair into a plurality of different patterns.

BACKGROUND OF THE INVENTION

Various types of hair treatments such a coloring, layering and perming require the careful separation of sections or "tufts" of hair. For example, a hair coloring treatment will produce inconsistent results if the hair stylist is unable to uniformly distribute the color treatment across the hair or section thereof. Presently, stylists typically separate hair into sections by supporting the hair on a pointed end of a styling comb and then weaving out individual hair sections. This approach fails to produce consistent or uniform sections and the resulting hair treatment is often less than satisfactory. One method for solving this problem was proposed in U.S. Pat. No. 3,952,755 to Fisher. The Fisher Patent describes a styling comb preferably employed with teeth of different root depths and widths. An elongated needle is supported in the comb to facilitate complete separation of hair sections. The comb described in the Fisher Patent, while providing certain advantages over prior art structures, is of limited flexibility because it fails to provide adequate separation of hair sections into a plurality of different and useful patterns. Moreover, the elongated needle used in this comb is cumbersome to work with and makes the manufacture of the comb prohibitively expensive.

There is therefore a need for an improved styling comb which overcomes the disadvantages of the prior art and which facilitates the separation of hair sections into a variety of different sections and/or levels to facilitate various types of hair treatments.

BRIEF SUMMARY OF THE INVENTION

The present invention is directed to an improved styling comb for use in hair treatments which overcomes the deficiencies associated with prior art combs. According to the invention, the basic styling comb comprises a back portion and a handle portion integrally formed with the back portion. The handle portion is adapted to be grasped by a hair stylist.

In the preferred embodiment, the styling comb includes a first plurality of teeth projecting outwardly from the back portion and being arranged in spaced pairs. The teeth in the respective pairs are spaced one from the other by a support, and the spaces (or kerfs) between the respective pairs are of greater depth than the spaces between the teeth in the pairs such that the first plurality of teeth are separated into first and second interleaved sections. The first plurality of teeth therefore provide dual-level separation capability.

The styling comb also includes a second plurality of teeth projecting outwardly from the back portion in a direction substantially opposite from the first plurality of teeth, with a portion of the second plurality of teeth arranged also in spaced pairs. The teeth in the respective pairs are again spaced one from the other by a support, and the space between the respective pairs are again of greater depth than the spaces between the teeth of each pair. Moreover, alternating pairs of teeth includes supports of first and second predetermined sizes such that the spaces between the teeth of alternating pairs vary between two depths which are both less than the depth of the spaces between pairs. The second plurality of teeth are therefore separated into third, fourth and fifth interleaved sections to provide tri-level separation capability.

BRIEF DESCRIPTION OF THE DRAWING

For a more complete understanding of the present invention and the advantages thereof, reference is now made to the following Description taken in conjunction with the Drawing in which.

DETAILED DESCRIPTION

Figure 1:
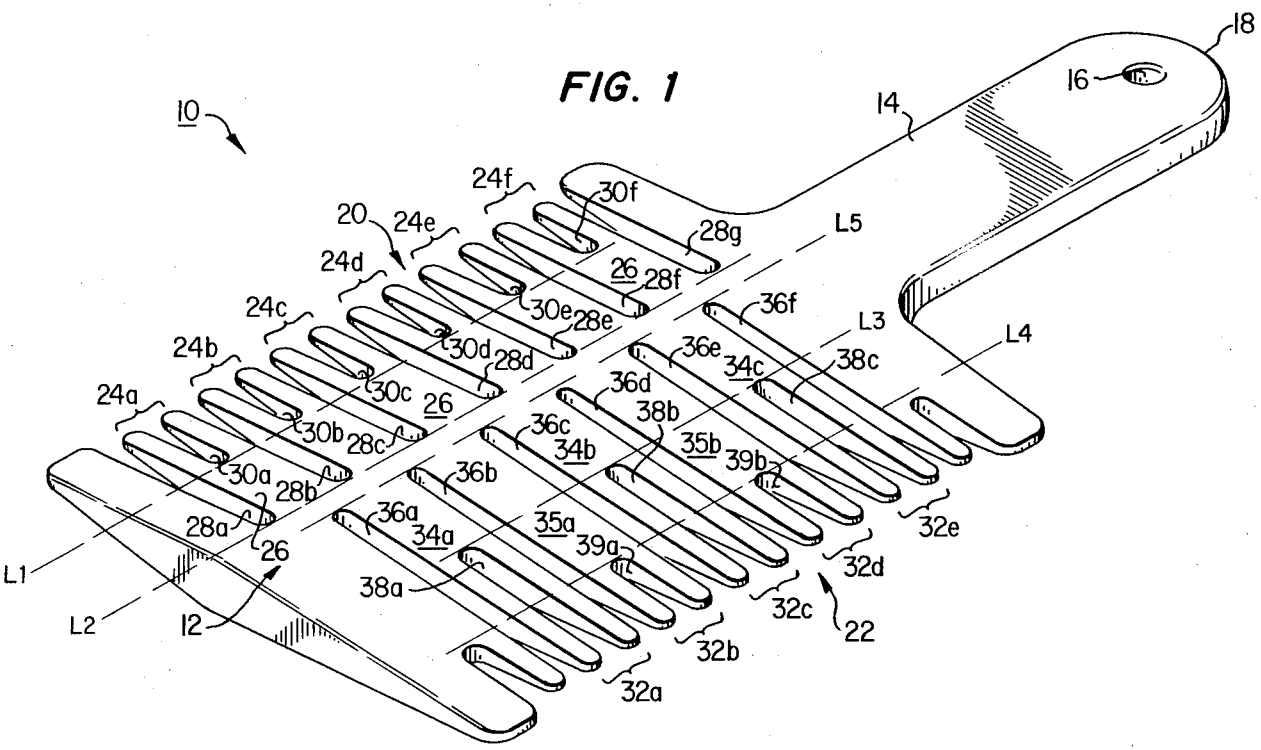
FIG. 1 is a perspective view of the preferred styling comb of the present invention.

With reference now to the drawing wherein FIG. 1 represents a perspective view of the preferred embodiment of the present invention, the styling comb 10 preferably includes an elongated comb back portion 12 and a comb handle 14 connected to the back portion 12 or integrally formed therewith. The comb 10 is preferably molded from any suitable plastic or rubber material which is strong and durable. A hole 16 is provided near the distal end 18 of the handle 14 for mounting the comb on a suitable support pin or the like.

As seen in FIG. 1, the styling comb 10 includes a first plurality of teeth 20 projecting outwardly from the comb back portion 12, and a second plurality of teeth 22 projecting outwardly from the comb back portion 12 in a direction substantially opposite from the first plurality of teeth 20. The first plurality of teeth are arranged in spaced pairs 24*a*–24*f*. The teeth in each respective pair 24 are spaced one from the other by a support 26, and thus the spaces or "kerfs" 28*a*–28*g* between the respective pairs 24*a*–24*f* are of greater depth than the spaces 30*a*–30*f* between the teeth in the pairs. In this manner, the first plurality of teeth 20 form first and second interleaved sections which provide dual level separation capability. These levels are designated L1 and L2 in FIG. 1. Of course, the use of six (6) pairs of teeth as shown on the comb in FIG. 1 is merely for exemplary purposes as any number of pairs may be used.

As also seen in FIG. 1, at least a portion of the second plurality of teeth is also arranged with spaced pairs of teeth 32*a*–32*e*. The teeth in each respective pair 32 are spaced one from the other by a support 34, and the spaces 36*a*–36*f* between the respective pairs 32*a*–32*e* are also of greater depth than the spaces between the teeth of each pair. Moreover, every other pair of teeth, such as pairs 32*a*, 32*c* and 32*e*, includes a support (34*a*, 34*b* and 34*c* respectively) of a predetermined size such that the spaces 38*a*, 38*b* and 38*c* between the teeth of such alternating pairs are at a level L3. The pairs 32*b* and 32*d*, however, include supports 35*a* and 35*b*, respectively, which form the spaces 39*a* and 39*b* between these pairs at a level L4. Levels L3 and L4 are both less than the depth L5 of the spaces 36*a*–36*f* between pairs 32*a*–32*e*. The second plurality of teeth thus are separated into third, fourth and fifth (or tri-level) interleaved sections. The second plurality of teeth 22 may also include end teeth 40*a* and 40*b*, and may include any number of teeth pairs.

As also seen in FIG. 1, the teeth forming the L2 level on the first plurality of teeth 20 are of substantially the same depth as the teeth forming the L3 level on the second plurality 22. Moreover, although not required, the kerfs 36*a*–36*f* of the second plurality of teeth 22 are aligned with the kerfs 30*a*–30*f* between the teeth in the pairs of the first plurality of teeth 20. For example, kerfs 36*a* and 30*a* are aligned along an axis 42 perpendicular to the comb back portion 12.

The styling comb of the present invention advantageously provides two-sided, five level separation. The comb enables the stylist to take one $\frac{1}{4}'' \times 3''$ section and divide the section into two-five levels. The first plurality of teeth 20 provide a maximum amount of hair separation, while the second plurality of teeth 22 provides separation with a choice of minimum amounts of hair in three different levels. The styling comb therefore gives the option of a minimum-maximum separation range and thus allows the accuracy of the hair treatment to far exceed any possibilities provided by prior art combs. This design enables the stylist to create a variety of divisions from one section of the hair and to select sections in various patterns.

Although the invention has been described and illustrated in detail, the same is by way of example only and should not be taken by way of limitation. The spirit and scope of the present invention are limited only to the terms of the appended claims.

I claim:

1. A styling comb for use in hair treatment, comprising:

a back portion;

a handle portion connected to said back portion for enabling a hair stylist to hold the styling comb;

a first plurality of teeth projecting outwardly from the back portion with the spaces between the teeth in the first plurality having either a first depth, or a second depth greater than the first depth, and wherein each space having the second depth is located between spaces having the first depth such that the first plurality of teeth are arranged to provide two-level separation on a horizontal section of hair supported in the first plurality of teeth; and a second plurality of teeth projecting outwardly from the back portion in a direction substantially opposite from the first plurality of teeth with the spaces between the teeth in the second plurality having either a third depth, a fourth depth greater than the third depth, or a fifth depth greater than the fourth depth, and wherein each space having the fifth depth is located between spaces having the third and fourth depths such that the second plurality of teeth are arranged to provide tri-level separation on a horizontal section of hair supported in the second plurality of teeth.

2. The styling comb for use in hair treatment as described in claim 1 wherein the spaces between teeth in the second plurality of teeth are aligned longitudinally with the spaces between teeth in the first plurality of teeth.

3. The styling comb for use in hair treatment as described in claim 1 wherein the handle portion is integrally formed with the back portion.

4. The styling comb for use in hair treatment as described in claim 1 wherein the back portion and the handle portion are formed of a molded plastic material.

5. The styling comb for use in hair treatment as described in claim 1 wherein the spaces in the first plurality of teeth having the first depth are aligned longitudinally with the spaces in the second plurality of teeth having the fifth depth.

6. The styling comb for use in hair treatment as described in claim 1 wherein the first depth is equal to the third depth and the second depth is equal to the fourth depth.

* * * * *